US006264880B1

(12) United States Patent
Elmer et al.

(10) Patent No.: US 6,264,880 B1
(45) Date of Patent: Jul. 24, 2001

(54) MANIFOLD FREE MULTIPLE SHEET SUPERPLASTIC FORMING

(75) Inventors: John W. Elmer, Danville, CA (US); Robert L. Bridges, Knoxville, TN (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 09/120,762

(22) Filed: Jul. 22, 1998

(51) Int. Cl.[7] ..... B29C 44/16

(52) U.S. Cl. ..... 264/572; 264/84; 264/521; 264/544; 72/56; 72/706

(58) Field of Search ..... 428/544, 577, 428/586, 596; 72/706, 56; 264/521, 84, 544, 572

(56) References Cited

U.S. PATENT DOCUMENTS

| | | | | |
|---|---|---|---|---|
| 4,077,109 | * | 3/1978 | Larson | 419/49 |
| 4,197,978 | | 4/1980 | Kasper | 228/173 A |
| 4,304,350 | | 12/1981 | Paez et al. | 228/118 |
| 4,304,821 | * | 12/1981 | Hayase et al. | 428/593 |
| 4,306,436 | * | 12/1981 | Schultz et al. | 72/21.1 |
| 4,434,930 | | 3/1984 | Trenkler et al. | 228/118 |
| 4,440,109 | | 4/1984 | Dugan et al. | 119/2 |
| 4,538,756 | | 9/1985 | Trenkler et al. | 228/118 |
| 4,577,797 | * | 3/1986 | Raymond | 228/118 |
| 4,588,651 | | 5/1986 | Israeli | 428/594 |
| 4,657,717 | * | 4/1987 | Cattannach et al. | 264/102 |
| 4,811,766 | | 3/1989 | Sastry et al. | 148/11.5 A |
| 5,099,573 | | 3/1992 | Krauss et al. | 29/889.2 |
| 5,275,325 | | 1/1994 | Stracquadaini | 228/44.3 |
| 5,284,288 | | 2/1994 | Woodward | 228/157 |
| 5,401,583 | | 3/1995 | Stacher et al. | 428/594 |
| 5,449,109 | | 9/1995 | Chuang et al. | 228/157 |
| 5,469,618 | | 11/1995 | LeMonds et al. | 29/889.72 |
| 5,564,064 | | 10/1996 | Martin | 419/5 |
| 5,611,944 | | 3/1997 | Gilkinson et al. | 219/117.1 |
| 5,636,440 | | 6/1997 | Bichon el al. | 29/889.72 |
| 5,946,802 | * | 9/1999 | Calle et al. | 29/889.721 |

* cited by examiner

*Primary Examiner*—Francis J. Lorin
(74) *Attorney, Agent, or Firm*—Alan H. Thompson

(57) ABSTRACT

Fluid-forming compositions in a container attached to enclosed adjacent sheets are heated to relatively high temperatures to generate fluids (gases) that effect inflation of the sheets. Fluid rates to the enclosed space between the sheets can be regulated by the canal from the container. Inflated articles can be produced by a continuous, rather than batch-type, process.

18 Claims, 4 Drawing Sheets

MANIFOLD FREE MULTIPLE SHEET SUPERPLASTIC FORMING

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to superplastic forming of multiple sheets in a manifold-free system, and more particularly to forming or shaping metal sheets with internally generated gas pressures.

2. Description of Related Art

Superplastic forming technology (SPF) has been frequently used in the aerospace industry to manufacture near net shape and stress free articles (i.e., components) through low strain rate forming operations under an applied pressure at elevated temperatures. Applied pressures and elevated temperatures have produced elongations up to 8000% or more in metals, up to 800% or more in intermetallics, up to 1400% or more in metallic composites, up to 1025% or more in ceramics, and up to 625% or more in ceramic composites. Recent SPF techniques involve laser welding or diffusion bonding to seal and join two or more sheets together in strategic locations so that when the assembly is pressurized with an inert gas at elevated temperature, the sheets inflate to fill the inside of a sealed die. After cooling, the manufactured component takes on the shape of the die, and may contain integrally stiffened members that are created when the strategically placed welds or bonds act as pinning points in the forming operation. Such multiple sheet SPF technology may show great promise at manufacturing complex shape structural components for the aerospace and other industries and has some advantages over conventional wrought metal forming processes and the like.

However, the commercial application of welded and SPF components has been economically limited, particularly due to high capital costs of SPF presses, to low throughput through the presses (e.g., batch modes) and by restrictions caused by connecting pre-inflated components to high pressure gas manifolds. Long forming times, on the order of hours, have discouraged improved SPF efforts.

In recent years, internally generated gas pressures have been employed to inflate malleable metal sheets. Trenkler et al. in U.S. Pat. No. 4,434,930 describe painting and sealing a pattern of thermally decomposable stop-off material onto an interfacial surface of two or more metal sheets, then solid phase green bonding the sheets and raising the temperature to decompose the stop-off material, thus generating gas and inflating the sheets contiguous to the pattern. However, such a technique suffers from employing inadequate and otherwise uncontrollable amounts of stop-off materials and consequently generating inadequate gas pressures. Oftentimes, the once-sealed painted patterns of the techniques such as those of Trenkler and others fail to provide additional stop-off material that can be added to generate additional internal gas pressure. Furthermore, the methods employing the once-sealed painted patterns have difficulty regulating the strain rate of inflatable superplastic materials and the like.

Accordingly, a need exists for more economical SPF methods that avoid batch processes and promote conveyor belt type processes, can avoid having to attach the components or articles to a high pressure manifold and can be manifold free, and offer flexibility in controlling or regulating fluid pressures during the formation of such articles.

SUMMARY OF THE INVENTION

The present invention relates to a method for forming a sheet into a desired shape by generating internal fluid pressures from a fluid-forming composition heated to a forming temperature in a container attached to the sheet. Novel articles are also produced by the invention. Such articles include (1) a container attached to at least two pre-inflated sheets, (2) shaped inflated sheets attached to the container, and (3) trimmed and finished, shaped inflated sheets for a desired use, such as aerospace components, vehicle exhaust manifolds, and the like.

In the method of the invention, a fluid, preferably a gas, is released from the heated fluid-forming composition in the container to exert gas pressure within an enclosed space between two or more heated adjacent, relatively flat sheets, e.g., materials exhibiting superplasticity, thereby inflating at least one of the sheets. An advantage of the invention is that the dimensions of a pathway between the fluid-forming composition in the container and the inflatable enclosed space of the desired article can be controlled to regulate gas flowrate to the enclosed space and thereby effect suitable strain rates to the sheet materials. Usually the container and any excess material is trimmed away from the resulting inflated article to produce a finished, or further-modifiable, inflated product. The method of the invention is useful as a continuous, rather than batch-type, process.

Inflated articles derived from the method of the invention can be utilized as intermediate or finished products. For instance, an article having a container (with or without the fluid-forming composition) attached to a pre-inflated sheet, can be transported to further manufacturers for article inflation. An inflated article attached to the container can be trimmed and finished at the location of formation or at a remote location therefrom.

DETAILED DESCRIPTION OF THE INVENTION

Figure 1:
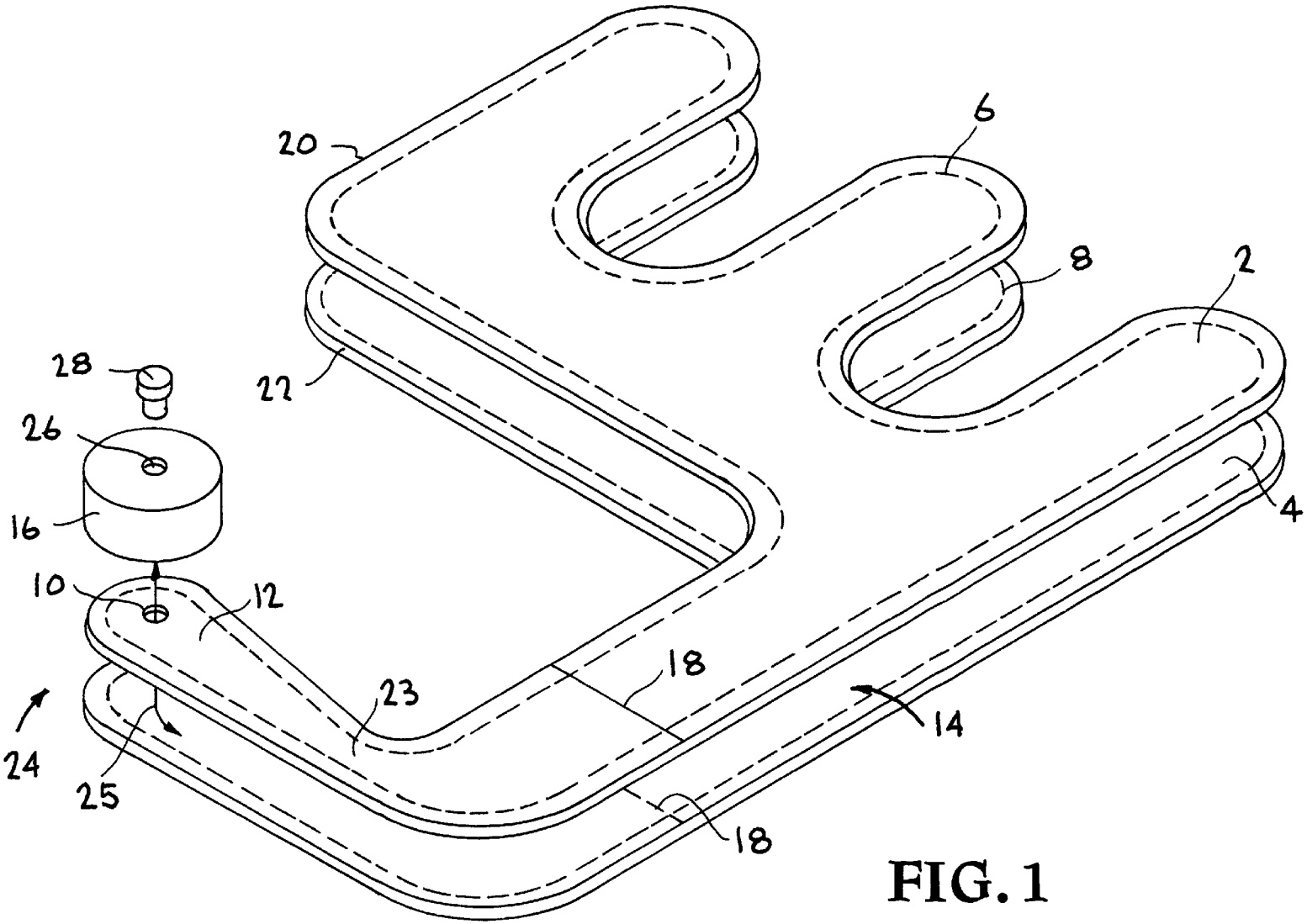
FIG. 1 describes an exploded view of a container attached to two adjacent sheets attachable about a contiguous pattern.

The method of the invention is directed to altering the shape of at least one solid sheet material when internal fluid pressures are exerted within a sealed cavity which is an enclosed space formed between two adjacently sealed sheets that are in fluid communication with an attached, sealed container of fluid-forming composition. The sheet material and the container attached thereto are normally heated from room temperature to an elevated temperature sufficient to (1) allow the sheet material to expand at a rate disallowing failure of the sheet material and normally the container material as well, and (2) allow the fluid-forming composition to generate enough fluid (usually a gas) at an equilibrium pressure sufficient to expand the sheet material. The method allows the skilled artisan to control the dimensions of the pathway fluidly communicating from the attached container to the targeted enclosed space between the adjacent sheets. Descriptions regarding enclosed containers, enclosed space between the sheets and an enclosed pathway for fluid communication between the enclosed container and enclosed space between the sheets are referred herein as sealed from the exterior atmosphere surrounding the container/sheet assembly. Furthermore, the method allows the skilled artisan to stoiciometrically pre-determine the quantities of fluid-forming composition necessary for predetermined inflation volumes necessary for altering the original shape of a particular sheet material at given elevated temperatures, yet not cause premature failure of the sheets. A "pre-inflated" sheet or sheets, as used herein, refers to a sheet or sheets of the solid sheet material that has (have) not been previously inflated by the heating of the fluid-forming composition to a forming temperature of the sheet(s). Pre-inflated sheets are usually relatively flat sheets prior to treatment by the method of the invention.

The method of the invention is generally utilized to shape sheets made of any material. Although sheet materials may comprise amorphous solids such as plastics and glasses, crystalline and polycrystalline solid materials are preferred. The typical sheets initially employed in the invention more preferably exhibit the property of superplasticity, i.e., are polycrystalline materials having the ability, in a generally isotropic manner, to exhibit very high tensile elongations prior to failure. Such sheets may include metallic, ceramic, intermetallic, or composite multiphase materials with uniform or nonuniform, relatively coarse (about 20 $\mu$m) to ultrafine (about 30 nm) grain sizes that have isotropic or anisotropic grain (phase) shape, size, or orientation. Ordinarily, the strain rates of such sheets are greater than about $10^{-6}$/sec and preferably greater than $10^{-4}$/sec. In most commercial operations such strain rates range from about $10^{-2}$/sec to about 100/sec. The thickness of the sheets is generally less than 0.125 inch, and preferably less than 0.06 inches. Most initial sheet thicknesses are in the range from about 0.01 to about 0.06 inches. The elongation of the materials is usually greater than 1 to about 1000%.

Preferred initially treated or pre-inflated sheets are normally relatively flat sheets. The original flat nature of the sheets is convenient for oven heating, mold control, and ease of handling during the initial manufacturing stages. The sheets are preferably metal-containing and/or metal-containing alloys that exhibit superplasticity, ductility and/or malleablility. The sheets should be capable of being sealed together, normally by such methods as fusion or laser welding. The sheets are not limited to materials capable of diffusion welding. Specific sheet examples include elemental metals (i.e., free metals) such as titanium, aluminum, nickel, copper, magnesium, iron, and free metal based alloys such as titanium-based alloys (>75% Ti) including Ti-6Al-4V, aluminum-based alloys (>50% Al) including AA 5083, nickel-based alloys including tradename Inconel 718, and microduplex, magnesium-based alloys, copper-based alloys, and iron-based alloys such as stainless steel alloys including tradenames Nitronic 19D and Superdux 65. Other examples of useful metallic alloys include: Al—Ca—Si, Al—Ca—Zn, Al—Cu, Al—Cu—Mn, Al—Cu—Si, Al—Cu—Zr, Al—Li, Al—Mg—Mn, Al—Mg—Cr, Al—Mg—Zr, Al—Zn—Mg, Cu—Al—Ni, Cu-42Zn, Cu—P, Cu—Zn—Ni, Nb—Hf—Ti, Ti—Mo—Sn—Zr, Ti-9V—Mo—Al, Ti-36Al, Ti—Al—Mo, Mg—Mn—Ce, Mg—Li, Mg—Al—Zr, Fe—Cr—Ni, Pb-62Sn, Zn-22Al, and Zn—Cu—Ti. Other metallic alloys and/or composites include: tradenames such as Supral 100, Supral 200, Al 8090, Al 2090, Weldalite, Al 5083, Al 7475, Al 7064, IN 9021, IN 90211, IN 905XL, IN 9051, IN 9052, IN 100, IN 625 LCF, MA6000, MA754, Coronze 328, Ti SP700, Ti IMI843, tool steel, UHC steel, Superdux 64, SKD11.PM steel, stainless steels, T15 PM HSS, HPb59-1 brass, $\alpha/\beta$ brass, $SiC_p$/7475 Al, $\alpha SiC_w$/2024Al, $\alpha SiC_w$/2124Al, $\alpha$ $SiC_w$/6061Al, $SiC_w$/7075Al, $\alpha Si_3N_{4(w)}$/2124Al, $\alpha Si_3N_{4(w)}$/7064Al, $\beta Si_3N_{4(w)}$/2024Al, $\beta Si_3N_{4(w)}$/6061Al, SiCp/6061Al, and $SiC_w$/Zn-22Al. Examples of useful intermetallics include: $Ni_3Al$, $Ni_3Si$, $Ti_3Al$, TiAl, $Fe_3(Si,Al)$, $Nb_3Al$, $Ni_3(Si,Al)$, Ni-9Si, Ti-34Al-2Mo, and Ni—Si—Ti (B) as well as intermetallics having the tradenames $\alpha$-2 and Super $\alpha$-2. Ceramics and ceramic composites include: Hydroxyapatite ($Ca_{10}(PO_4)_6(OH)_2$), $Si_3N_4$/SiC, $A1_2O_3$, $3Al_2O_3$-$2SiO_2$, $Si_{6-X}Al_XO_YN_8$, $M_{Z/N}Si_{6-X-Z}$, $Al_{X+2}O_XN_8$, Si—Al—M—N—O, $A1_2O_3$:Pt(95:5), $BaTiO_3$, ZnS, ZnS/diamond, $PbTiO_3$, $Fe_3C$/Fe, WC/Co, $YBa_2Cu_3O_{7-X}$, $YBa_2Cu_3O_{7\ Y}X$+Ag, as well as ceramics having the tradenames YTZP and YTZP/$Al_2O_3$. Accordingly, pre-inflated and inflated articles of the invention contain such sheet material.

Two of such sheets are illustrated in FIG. 1 as being attached to a container for at least one fluid-forming composition. In the method of the invention, an upper sheet 2 is placed adjacent to a lower sheet 4. Any shaped sheet capable of having its shape altered or further altered by the effects of elevated temperatures and pressures can be employed, for convenience of manufacture and economical considerations; however, such sheets are usually initially flat or relatively flat. The shape and size of the sheets is normally determined by the dimensions of the desired finished article. Since both simple and complex shaped finished articles and products can be produced by the method of the invention, multiple layers of such sheets (not shown) can arranged adjacently to sheets 2 and/or 4.

A selected or desired contiguous pattern 6 is marked on upper sheet 2 and a substantially similar and/or congruent pattern 8 marked on lower sheet 4. The sheets can be sealed about each other at or near the marked patterns by sealing means suitable for the particular composition of the sheet material. The sealing means is adapted to the particular composition of the sheet material so as to provide a seal that is maintained at the particular forming temperature and pressure of the sheet material. For instance, free metal-containing sheets and alloys thereof can be fusion welded, such as by welding methods employing a laser beam, an electronic beam, an arc, a plasma arc, and/or resistance. The preferred method is laser welding due to its precise weld positioning, its low and localized heat input, and its adaptability to flexible manufacturing, which allow complex weld shapes to easily be produced on such sheets.

An opening or aperture, i.e., hole 10, eventually serving as a gas inlet port, can be drilled through upper sheet 2 after the sheets are sealed (i.e., closed to the exterior atmosphere); however, in at least one embodiment, it is preferred that such a hole be formed prior to either the initial adjacent placing and/or sealing of the sheets. The hole provides fluid communication between the outside area 12 above hole 10 and a space 14 between upper sheet 2 and lower sheet 4. The location of hole 10 is usually within the perimeter of contiguous pattern 6 of upper sheet 2 (which is sealable along the perimeter of congruent pattern 8 on lower sheet 4), although as can be illustrated hereinafter in FIG. 4, such hole location is not mandatory and sometimes not preferred, depending upon the desired finished inflated article.

A container 16, for holding the fluid-forming composition, is sealed (such as by welding) to upper sheet 2 to maintain hole 10 within or in contact with the perimeter of the container. The composition material of the container should be capable of forming a seal with the composition of the sheet material either with or without additional adhesives or means of attachment. The strength of the container composition material should be sufficient to withstand an internal fluid (gaseous) pressure exerted by the fluid(gas) forming composition. Ordinarily at the elevated temperatures necessary for sheet inflation or alteration, the strength of the container composition material is as strong as, or stronger than that of the attached, inflatable sheet material. In a preferred embodiment, the container composition material is the same material as that of the sheet material.

After such sealing (such as by welding) of the container to the sheet material, the internal volume of container 16 is in fluid communication with open space 14 via hole 10. Ordinarily container 16 is sealed on upper sheet 2 within contiguous pattern 6 at a location (shown generally as 24) outside the boundaries of the eventually inflated and/or finished article. For example, container 16 can be located exterior to the desired shape of the finished article at trim line 18. Accordingly, as illustrated hereinafter in FIG. 5, after eventual inflation of the sheets forming an article, excess material 20 and 22 from upper sheet 2 and lower sheet 4, respectively, located outside the contiguous patterns 6 and 8, respectively, and material 24 shown generally outside trimline 18, is trimmed away from the inflated article. In an alternative embodiment, the container can also be trimmed away from the surface adjacent that of the desired inflated article, e.g., a container is attached within the contiguous pattern forming the inflated shape, or within at least a portion of the pattern.

A feed hole 26 is drilled on the upper portion of container 16 and the container is filled with a pre-determined amount of the fluid-forming composition. The fluid-forming composition is then sealed in container 16, such as by employing a sealing plug 28 welded into feed hole 26 to produce an enclosed container. In another embodiment, the same opening(s) of the container utilized to fill or prepack the container with fluid-forming composition, such as feed hole 26, can be coaligned with hole 10 prior to sealing the container to the sheet(s) material(s). Thus, in the invention, an enclosed pathway 25 is formed that allows fluid communication between the internal volume of the container and the enclosable (or eventually enclosed) open space 14 between the adjacent sheets desired for inflation. In the method of the invention, essentially no generation of fluid (gas) from the fluid-forming composition occurs during the sealing of the container to the sheets prior to elevating the temperature of the entire container/sheet assembly during the shaping of the sealed adjacent sheets due to internal fluid(gas) pressures.

Figure 2:
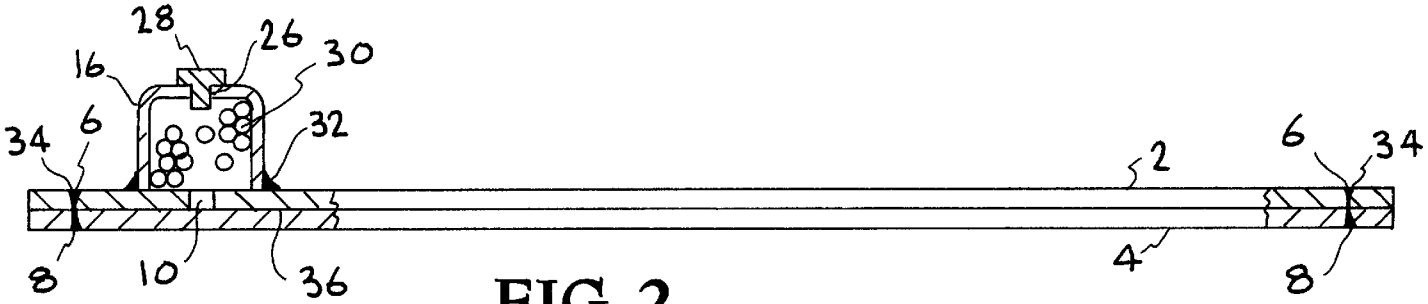
FIG. 2 describes a side view of a container attached to adjacent metal-containing sheets.

Container 16, filled with fluid-forming composition, is illustrated in FIG. 2 in a side view of a sealed, pre-inflated embodiment shown in FIG. 1. Container 16, containing fluid-forming composition 30, is sealed to adjacent sheet 2 at all points along a lower perimeter seal 32 of the container and also about its upper portion at feed hole 26 with sealing plug 28, thus forming an enclosed container to the exterior atmosphere. In this view, adjacent sheets 2 and 4 are sealed at all points along the perimeter seal 34 of the contiguous patterns 6 and 8, respectively, and trimline 18 intersects the patterns. The net result of such sealing is the formation of an enclosed (and inflatable) space 36 between upper and lower sheets 2 and 4 (i.e., formed from the previously open space 14 in FIG. 1). Accordingly, enclosed and inflatable space 36 is in enclosed (i.e., airtight) fluid communication with the interior of container 16 (including fluid-forming composition 30) through pathway 25 via hole 10. Thus, the enclosed space 36 in the cavity between the sealed adjacent sheets and the interior of the enclosed container are sealed from the atmosphere exterior to the container/sheet assembly.

It is a feature of the invention that the predetermined dimensions of a portion of enclosed space 36 (in FIG. 2), e.g., located between about hole 10 and trimline 18, can determine the fluid (gas) flow rate to a portion of the remainder of enclosed space 36. As for example, a narrow portion 23 of contiguous patterns 6 and 8 of FIG. 1 located between hole 10 and trimline 18 can be predetermined such that after sealing such patterns to produce enclosed space 36 (in FIG. 2), the dimensions of enclosed pathway 25 between hole 10 and trimline 18 can be controlled. Consequently the flow rate of the generated fluid/(gas) from container 16 can be regulated as the fluid enters and inflates enclosed space 36. Any combination of varying the dimensions of the gas inlet hole from the container, the width, length (and volume) of the canal from the gas inlet hole to the desired inflatable portion of the enclosed adjacent sheets, and temperature increase rates can provide regulation of gas flow rates to the desired inflatable article. Regulation of the flow rate of the fluid provides for an infinite number of shapes to the finished inflated articles.

Figure 3:
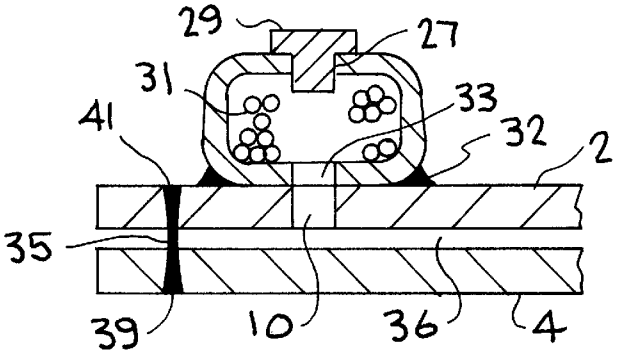
FIG. 3 describes a sealed canister-type container having a sealed gas outlet port to a partial sheet assembly.

In another embodiment of the container as illustrated in FIG. 3, the fluid-containing composition 31 can be prepacked through feed hole 27 in a predetermined quantity into the container 17 and sealed with fill plug 29, followed by the drilling of an gas port 33 (that is alignable with hole 10) through a lower surface of container 17 prior to the sealing of container 17 to upper sheet 2. FIG. 3 also illustrates that an end seal 35 of upper sheet 2 to lower sheet 4 can be the result of arc welding and the like at the respective pre-cut perimeters 39 and 41 of the sheets, such that no trimming of the sheets is necessary except in the vicinity of a container seal 43 that seals the container to upper sheet 2. Furthermore, both feed hole 27 and gas port 33 can be drilled concurrently.

Figure 4:
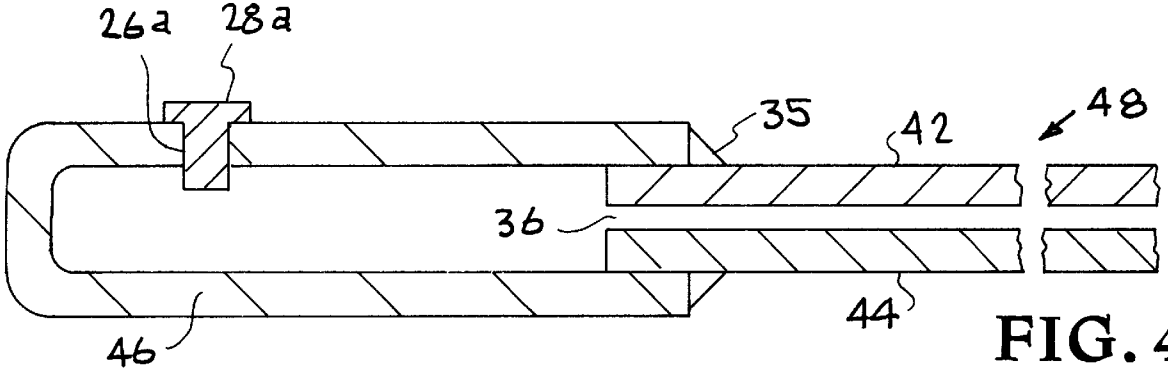
FIG. 4 describes an alternate sealed assembly having a container sealed about a peripheral portion of adjacent sheets.

FIG. 4 illustrates a side view of an end-sealed container. Upper and lower adjacent sheets 42 and 44, respectively, are attached to a container 45 on their respective upper and lower surfaces by welds 46. Fluid-forming composition 30 is fed to within container 45 through feed hole 26*a* which is subsequently sealed with sealing plug 28*a*. Upon sufficient heating of the sheets and container to an elevated temperature, fluid(gas) generated from fluid-forming composition 30 passes through an enclosed space 36 located between sheets 42 and 44 to inflate the sheets into a desired shape. After inflation of the sheets the container is trimmed away from adjacent sheets 2 and 4 of an inflated article along trimline 48.

The fluid-forming composition fed from the otherwise sealed container to within the enclosed (i.e., sealed) space surrounded by the described sheets is preferably a gas-forming composition capable (upon sufficient heat applied thereto) of generating an internal equilibrium pressure in the enclosed space which causes alteration to the shape of the sheet material. Usually the internal pressure generated by the fluid-forming composition is effected by heating the fluid-forming composition from about room temperature, i.e., 20 degrees Celsius (RT), and from about normal atmospheric pressure, i.e. 14.7 p.s. i. a. (RP), thus usually from about RTP. to elevated temperatures above 100 degrees C., and normally above 350 degrees C. In the case of free metal-containing sheets, an elevated temperature in the range from about 350 degrees C. to about 1200 degrees C. is preferred. For example, free aluminum-containing sheets are normally inflatable by heating the fluid-forming composition to a temperature in the range from about 300 degrees C. to about 600 degrees C., whereas free titanium-containing sheets and/or stainless steel-containing sheets are typically inflatable with elevated temperatures of about 650 degrees C. to about 1200 degrees C. It should be understood that the known fluid-forming (preferably gas-generating) temperature of the selected fluid-forming composition is usually correlated with the known temperature at which a selected sheet material will exhibit properties promoting sheet inflation, such as superplasticity, ductility, malleability, elongation and the like.

The fluid-forming composition, and more particularly a gas-generating composition sealed in the container, can exist as a liquid, solid, or mixtures thereof, at room temperature. The liquid compositions generally have a lower equilibrium vapor pressure e.g., liquid water to steam, and are utilized to shape the sheets comprising the metals and/or alloys having relatively lower melting temperatures, i.e., less than 500 C. Small aggregate, finely divided, or powder solid forms of the fluid-forming or gas-forming compositions are convenient forms for filling through relatively small fill openings in the container. Solids containing water of hydration are useful. Liquids, such as water, can be combined with such finely divided forms in the container prior to heating. A preferred technique of filling the container is injection by small diameter (<¼ inch. dia.) tubing or needles, such as syringes, particularly due to the ease of sealing the container after filling.

Usually the solid gas-generating compositions are capable of generating higher equilibrium pressures and can shape sheets having metals and/or alloys having relatively high melting temperatures, i.e., greater than about 500 C. Hydrated solid composition can be employed. Preferred examples of the fluid-forming composition include ammonium carbonate, calcium carbonate, copper carbonate, calcium magnesium carbonate, iron carbonate, magnesium carbonate, manganese carbonate, zinc carbonate calcium hydride, lithium hydride, titanium hydride, calcium hydroxide, lithium hydroxide, copper nitride, azobisforamide, raw kyanite, calcium titanate, boron nitride, bisphenol A-epichlorohydrin, epoxy ink, black polyester and aromatic polyimide polymer. Some compounds which have explosive properties may be employed under properly controlled conditions. Examples include lithium nitrate, potassium nitrate, silver nitrate, magnesium nitride, erbium oxalate, and magnesium oxalate, and manganese oxalate.

The sealed container attached to the pre-inflated article, including the fluid-forming composition sealed within the container, is an independent article that can be heated, for inflation purposes, in any heating apparatus capable of reaching elevated temperatures, particularly ovens, furnaces, including vacuum furnaces and inert atmosphere furnaces, or other heating methods that generally raise the temperature at a controlled rate above room temperature, usually above 100° C., and ordinarily to within the range from about 200° C. to about 1200° C. for free-metal inflation, and higher for other sheet materials. More particularly an oven having the capability of feeding and removing the articles in a continuous manner, such as an assembly line-type manufacturing process. The pre-inflated or partially-inflated articles may be heated in suitable time intervals so that overly rapid expansion (and/or failure) of the sheets is prevented. When noticeable inflation of the article begins, the temperature of the container and sheet material is held at such an expansion or forming temperature until the desired inflation is completed at that temperature. Optionally, one or more additional fluid-forming compositions which generate fluid (gas) at a higher forming temperature than the first fluid-forming composition, may also be included in the sealed container thereby causing further inflation of the partially inflated article at a higher temperature.

In some cases, a manifold or mold can be placed about the pre-inflated sheets prior to the article reaching the forming temperatures of the sheet materials. The manifold can be designed to allow limited expansion or inflation of the article at pre-selected areas of the predetermined contiguous patterns previously marked and sealed on the adjacent inflatable sheets. For instance, repeating a simple circular shaped contiguous on the sheets the inflated parts may take on the appearance of "bubble wrap" packaging material. Furthermore, rather than free-forming the inflated portion from the sealed adjacent sheets, a sealed die can be placed around the sealed flat sheets prior to inflation (i.e., prior to forming), and as the inflated article forms within the die cavity, the shape of the article will take on the shape of the die to form any complex contours and shapes that have been machined into the die.

In an alternate embodiment, a single common container can be utilized for shaping two or more shaped articles, e.g., partially or fully inflated sheets. Inversely, a plurality of containers can be employed to shape one or more inflatable cavities in a single article. Furthermore, two or more fluid-forming compositions can be heated to different elevated temperatures in one or more containers during the course of preparation of a given finished article. In the case of producing a product having more than two sheets, the outer sheets, those not in contact with the generated gas during shaping, optionally need not be sealed during gas generation and sheet shaping, provided at least one enclosed space is inflated. Furthermore, by altering the sealing sequence between adjacent multiple sheet layers, a resulting multiple sheeted inflated article can be manufactured with integral stiffening members, such as those employed in honeycomb structures. A matrix of possible multiple layered articles prepared by the method of the invention is enormous and readily apparent to a skilled artisan.

The container attached to the inflatable sheets allows the skilled artisan to control the volume of gas generated within the pattern of space between the sealed adjacent sheets. By the present invention, the container allows one to generate a larger volume of gas that can be delivered at a controlled rate either faster or slower than those of painted embodiments. The gas volume generated from the amount of fluid-forming composition that is capable of being held by the herein described container can be at least 5, and often more than 10, times that capable of being generated by conventionally painted stop off materials. However, the method of the invention can include attaching the container to adjacent sheet surfaces that have been painted or treated with fluid-forming composition. Accordingly, the generation of fluid, particularly gas internal pressures from the combination of two sources, i.e., from the container and from painted sheet surfaces, greatly enhances the control of inflation rates and article shape by the skilled artisan.

Figure 5:
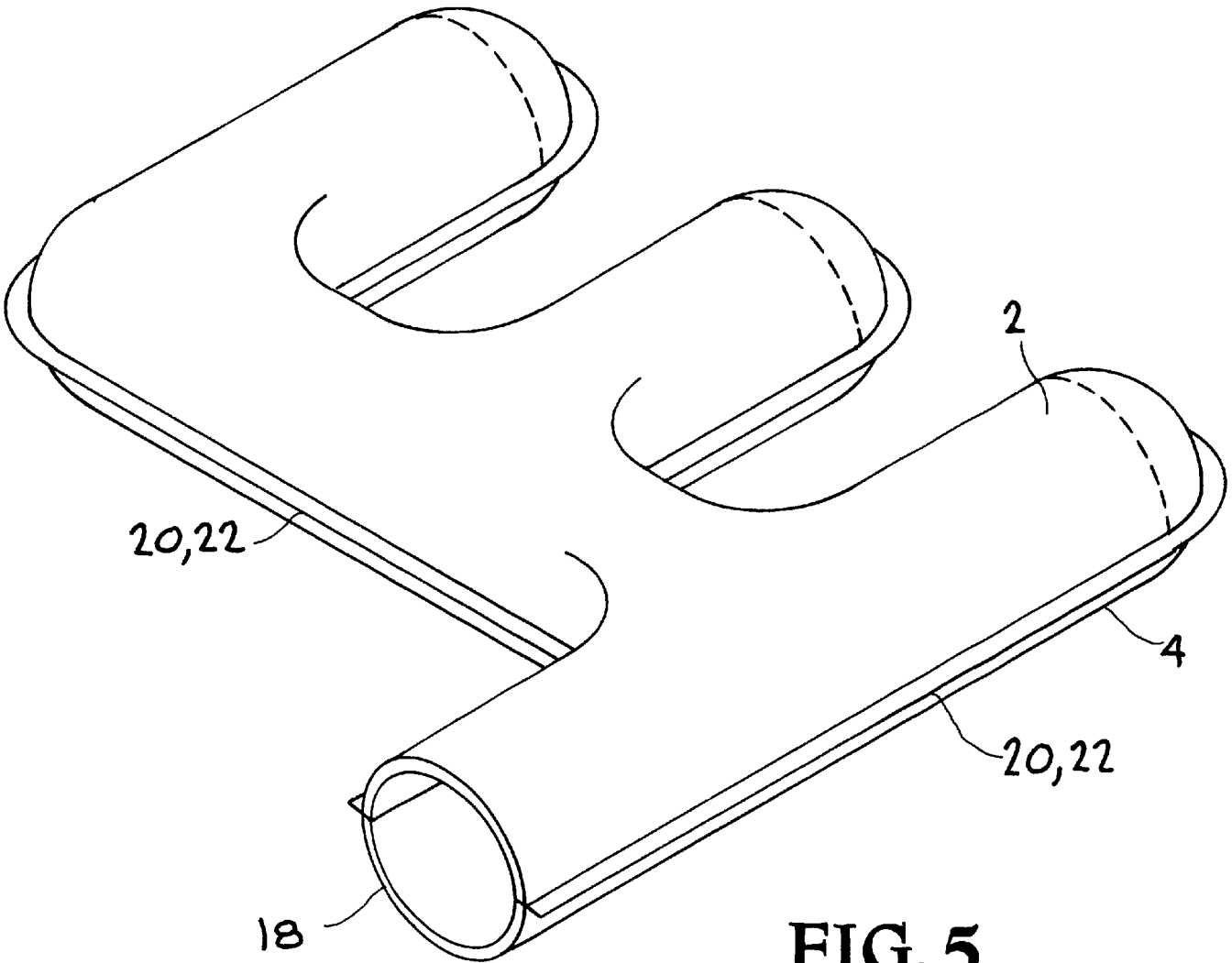
FIG. 5 describes an inflated article having partially trimmed material.
Figure 6:
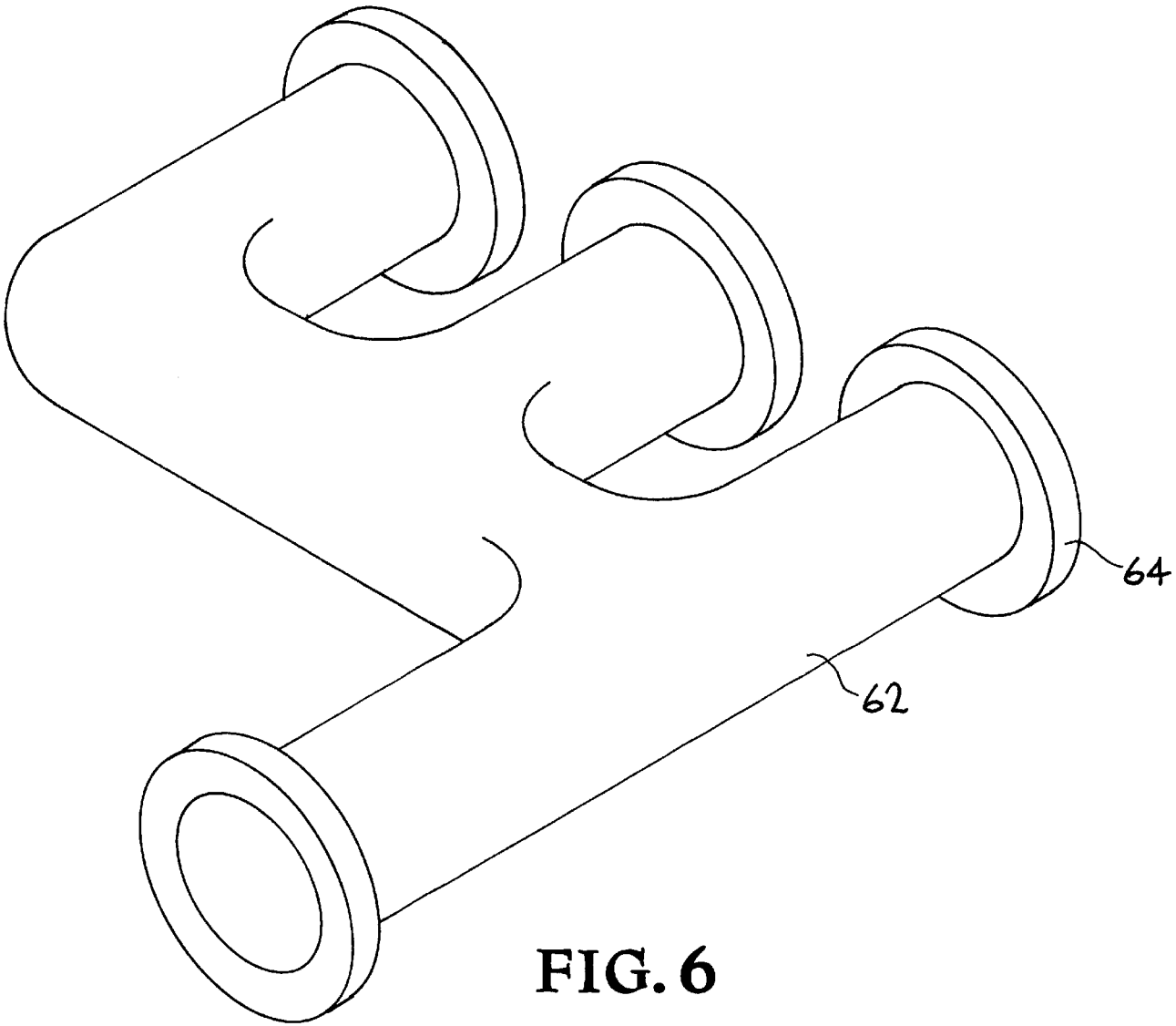
FIG. 6 describes a finished inflated vehicle exhaust manifold article containing flange modifications.

After the desired inflation of the expanded article is complete and the appropriate cooling steps taken and completed, the resulting inflated article can be transported to remote locations in an unfinished condition, or the extraneous portions trimmed from the article at or near the inflating location. FIG. 5 illustrates a partially trimmed inflated article 50 resulting from an initial contiguous pattern similar to that shown in FIG. 1. The container (not shown) has been trimmed away from inflated article 50 along trimline 18 while further cutting along trimlines 56, 58 and 60 can provide an open space article which is available for further modification toward completion of a finished shaped article. After excess sheet material 20 and 22 is trimmed from the shaped upper and lower sheets 2 and 4, respectively, the fully trimmed article can be transported for use or further modification. By way of illustration in FIG. 6, the trimmed inflated article 62 shown in FIG. 5 can be modified by, for instance, attaching one or more flange(s) 64 during the production of an vehicle engine exhaust manifold.

The method of the invention and the articles derived therefrom provide several advantages over conventional methods and previous products. Manufacturing methods employing the invention require reduced capital investment, reduced manufacturing complexity and reduced operational costs. For example, pre-inflated flat sheets are easily stored; the pre-inflated articles with attached containers can be transported from manufacturing location to heating location either with or without fluid-forming composition prior to heating; the containers holding the fluid-forming composition and attached to the pre-inflated flat sheets can continuously be supplied to a conveyor belt and heating oven arrangement, with a continuous output of inflated articles in contrast to a batch process. The self-contained pre-inflated or partially-inflated articles of the invention avoid a source of gas from outside the heating area and carefully controlled dimensions of the fluid communication pathways between the container and adjacent sheets can allow the skilled artisan to precisely control the rates of inflation of the enclosed cavities of the sheets. Useful products prepared by the method of the invention are endless and include such articles as auto exhaust manifolds, heat exchangers, aerospace structures, specialty bellows, spheres, and the like.

EXAMPLE 1

A method of the invention is employed to produce three articles useful in engine manufacturing. The method effectively produces (1) pre-inflated intermediate articles, (2) inflated intermediate articles usually requiring some finishing, e.g., trimming, and (3) finished exhaust manifolds for automobiles or similar vehicles.

Initially, two 6 inch by 8 inch blanks of SuperDux 65 stainless steel sheets, each having a thickness of approximately 0.04 inch, is sheared from stock stainless sheets. A gas inlet hole is cut in one of the blanks with a NdYAG laser, the sheets are cleaned, degreased, placed adjacent to each other in the sandwich manner shown in FIG. 1, clamped for welding and $CO_2$ laser welded (1100 Watts, 30 inch/min) in one continuous weld in a closed, pre-inflated pattern that will eventually form an inflated pattern that can be trimmed and/or cut to a finished engine exhaust manifold shape. A computer numerical controller is employed to follow the pre-inflated pattern. The pre-inflated pattern is formed with a measured distance across the pattern between the gas inlet hole and the trimline so as to pre-determine the gas flow rate from the gas inlet hole to the desired inflatable portion of the sheets. The gas inlet hole is kept within the closed continuous pattern to ensure the creation of an enclosed space between the sheets that is capable of receiving and responding to internal gas pressure.

After the excess material is NdYAG laser cut(200 Watts, 10 inch/min) away from the $CO_2$ laser welded pre-inflated pattern, a hydroformed, cup-shaped, 304 stainless steel (0.04 inch thick) container (e.g., canister) is gas tungsten arc welded to the welded sheet having the gas inlet hole. A one sixteenth inch hole in the bottom of the canister is aligned during welding to mate with the gas inlet hole of the welded sheet. The resulting integrated canister/two sheet article can then be utilized for producing a pre-inflated intermediate article.

A small hole is drilled in the top of the canister and a hypodermic syringe is utilized to inject a fluid-forming composition, i.e., 2.0 grams of dolomite powder ($CaCO_3$+$MgCO_3$), into the canister. The 2.0 grams of dolomite powder was pre-determined amount sufficient to eventually inflate the closed pattern of the adjacent two stainless steel sheets to a desired volume of inflation. After filling the canister, a small 308 stainless steel plug is laser welded into the small hole to seal the canister and also, in effect, provide a sealed overall pre-inflated, canister/two sheet article.

In this case, an assembly is formed wherein the canister/two sheet article is placed into a flat-plate restraining fixture having approximately 0.5 inch separation between parallel, restraining plates. Such an assembly is placed into a vacuum brazing furnace that is evacuated to 1×10−6 torr pressure and then heated by ramping the temperature to 950 degrees C. during 30 minutes. Noticeable inflation of the article begins at a forming temperature of about 900 degrees C. and the forming temperature is held at 950 degrees C. for 15 minutes to allow for complete and/or desired inflation of the adjacent sheets. The inflated article is cooled in vacuum to 100 degrees for approximately 1 hour and removed from the furnace.

The canister and other excess material is then trimmed from the inflated article. In this case, the trimming includes cutting openings in the inflated enclosed space and the addition of flanges, such as shown in FIG. 5, to produce a finished engine exhaust manifold article.

EXAMPLE 2

A method of continuously producing multiples of the inflated articles of Example 1 is exemplified.

A supply of several of the sealed overall pre-inflated, canister/two sheet articles manufactured in Example 1 is continuously placed into restraining fixtures on a conveyor belt leading to a furnace. The intermediate inflated articles are removed from the conveyor belt upon exit from the furnace. The restraining fixtures are removed and the canisters and other excess materials are then trimmed from the inflated articles. The inflated articles are then passed to the finishing stage for cutting to specification and additional modification.

During the manufacturing operation and after cooling the inflated article, the amount of fluid-forming dolomite powder composition injected and sealed into the partially inflated canister/two sheet articles is increased to 4.0 grams and the separation space between the parallel restraining fixtures is adjusted to 0.8 inches. The operation continues while inflated articles having greater volumes are produced.

In a modification of the above manufacturing method, a canister having four openings is welded to and sealed about four pair of adjacent sheets having welded continuous patterns. Eight grams of dolomite is injected into the canister and sealed in a similar manner as above. In an otherwise similar method as above, the four inflated articles derived therefrom may have the same or different shapes.

What is claimed is:

1. A method for inflating at least one of two adjacent sheets, said method comprising:

sealing a space between said adjacent sheets except for at least one fluid communication opening from said space;

sealing a container containing a fluid-forming composition about said fluid communication opening;

concurrently heating said adjacent sheets and said container to generate sufficient internal fluid pressure from said fluid-forming composition to alter a shape of at least one of said adjacent sheets.

2. The method defined in claim 1 wherein said fluid-forming composition is selected from the group consisting of ammonium carbonate, calcium carbonate, copper carbonate, calcium magnesium carbonate, iron carbonate, magnesium carbonate, manganese carbonate, zinc carbonate calcium hydride, lithium hydride, titanium hydride, calcium hydroxide, lithium hydroxide, lithium nitrate, potassium nitrate, silver nitrate copper nitride, magnesium nitride, magnesium nitride, erbium oxalate, magnesium oxalate, manganese oxalate, azobisforamide, raw kyanite, calcium titanate, boron nitride, bisphenol A-epichlorohydrin, epoxy ink, black polyester and aromatic polyimide polymer.

3. The method defined in claim 1 wherein at least one of said adjacent sheets is selected from the group consisting of metallics, intermetallics, ceramics, and composites thereof.

4. The method defined in claim 1 wherein at least one of said adjacent sheets exhibits superplasticity.

5. The method defined in claim 1 wherein at least one of said adjacent sheets contains a superplastic metallic or superplastic metallic alloy.

6. The method defined in claim 1 wherein at least one of said adjacent sheets contains a metallic selected from the group consisting of titanium, aluminum, copper, nickel, iron, magnesium, titanium-based alloys including Ti-6Al-4V, aluminum-based alloys including AA 5083, nickel-based alloys including Inconel 718, and microduplex stainless steel alloys including Nitronic 19D and Superdux 65.

7. The method defined in claim 1 further comprising trimming an excess portion of at least one of said adjacent sheets after initiation of said heating.

8. The method defined in claim 1 further comprising trimming said container from at least one of said adjacent sheets after initiation of said heating.

9. A method for altering the shape of at least one superplastic sheet, said method comprising:

(1) enclosing a space between at least two adjacent sheets, except for an opening capable of fluid communication with said space, at least one of said adjacent sheets having at least one superplastic property;

(2) attaching a container to at least one of said adjacent sheets;

(3) supplying an interior portion of said container with a gas-forming composition;

(4) sealing said container except for a container opening capable of fluid communication with said interior portion of said container;

(5) sealing said container opening about said opening;

(6) concurrently heating said sheets and said container to generate sufficient gas from said gas-forming composition to alter a shape of said adjacent sheet having at least one superplastic property; and (5) removing said container.

10. The method defined in claim 9 wherein said space is sealed by laser welding.

11. The method defined in claim 9 wherein the geometric dimensions of said opening and said container opening are predetermined to provide controlled gas rate to said space.

12. The method defined in claim 11 wherein said fluid-forming composition is selected from the group consisting of ammonium carbonate, calcium carbonate, copper carbonate, calcium magnesium carbonate, iron carbonate, magnesium carbonate, manganese carbonate, zinc carbonate calcium hydride, lithium hydride, titanium hydride, calcium hydroxide, lithium hydroxide, lithium nitrate, potassium nitrate, silver nitrate copper nitride, magnesium nitride, magnesium nitride, erbium oxalate, magnesium oxalate, manganese oxalate, azobisforamide, raw kyanite, calcium titanate, boron nitride, bisphenol A-epichlorohydrin, epoxy ink, black polyester and aromatic polyimide polymer.

13. The method defined in claim 9 wherein at least one of said adjacent sheets contains a metallic selected from the group consisting of titanium, aluminum, copper, nickel, iron, magnesium, titanium-based alloys including Ti-6Al-4V, aluminum-based alloys including AA 5083, nickel-based alloys including Inconel 718, and microduplex stainless steel alloys including Nitronic 19D and Superdux 65.

14. A method for forming a metallic sheet, said method comprising:

(1) applying a fluid-forming composition to a surface of said first metallic sheet;

(2) covering said surface of said metallic sheet with a second metallic sheet;

(3) sealing at least a portion of said surface between said first metallic sheet and said second metallic sheet to form a closed space between said sheets except for at least one opening from said closed space;

(4) attaching a container having a container opening and a solid or liquid fluid-forming composition to said sheets and sealing said container opening; and (5) concurrently heating said sheets and the container thereby generating sufficient fluid from said fluid-forming composition to alter a shape of said metallic sheet.

15. The method of claim 14 wherein a shape of said second metallic sheet is altered.

16. The method of claim 14 wherein gas is generated from said solid or liquid fluid-forming composition in said container.

17. A method for forming an article comprising:

forming a space between at least two adjacent sheets;

attaching a container containing a fluid-forming composition to at least one of said adjacent sheets;

forming an enclosed pathway for fluid communication between said container and said space and concurrently heating said sheets and the container to generate sufficient internal fluid pressure from said fluid-forming composition to alter the shape of the article.

18. A method for forming an article comprising:

forming an enclosed space between at least two adjacent sheets, except for at least one opening to said enclosed space;

attaching a container having an interior capable of containing a fluid-forming composition to at least one of said adjacent sheets;

forming a closed pathway for fluid communication between said interior of said container and said enclosed space and concurrently heating said sheets and the container to generate sufficient internal fluid pressure from said fluid-forming composition to alter the shape of the article.

* * * * *